US008129966B2

(12) United States Patent
Takagi

(10) Patent No.: US 8,129,966 B2
(45) Date of Patent: Mar. 6, 2012

(54) VOLTAGE REGULATOR CIRCUIT AND CONTROL METHOD THEREFOR

(75) Inventor: Yoshiki Takagi, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 327 days.

(21) Appl. No.: 12/041,812

(22) Filed: Mar. 4, 2008

(65) Prior Publication Data

US 2008/0218139 A1 Sep. 11, 2008

(30) Foreign Application Priority Data

Mar. 7, 2007 (JP) ..... 2007-057219

(51) Int. Cl.
*G05F 1/40* (2006.01)
*G05F 1/44* (2006.01)

(52) U.S. Cl. ..... 323/280; 323/282; 323/284; 323/285; 323/274; 323/275

(58) Field of Classification Search ..... 323/280, 323/282, 284, 285, 274, 275
See application file for complete search history.

(56) References Cited

U.S. PATENT DOCUMENTS

| | | | | |
|---|---|---|---|---|
| 5,512,814 | A * | 4/1996 | Allman | 323/267 |
| 6,465,994 | B1 * | 10/2002 | Xi | 323/274 |
| 6,541,946 | B1 * | 4/2003 | Chen et al. | 323/280 |
| 6,703,815 | B2 * | 3/2004 | Biagi | 323/280 |
| 6,703,816 | B2 * | 3/2004 | Biagi et al. | 323/280 |
| 7,002,329 | B2 * | 2/2006 | Agari et al. | 323/284 |
| 7,215,180 | B2 * | 5/2007 | Nagata et al. | 327/538 |
| 7,368,896 | B2 * | 5/2008 | Nagata et al. | 323/280 |
| 7,545,128 | B2 * | 6/2009 | Nakajikkoku | 323/281 |
| 7,545,610 | B2 * | 6/2009 | Nagata | 361/18 |
| 2005/0231180 | A1 * | 10/2005 | Nagata et al. | 323/268 |
| 2006/0232327 | A1 * | 10/2006 | Takagi et al. | 327/541 |
| 2008/0238385 | A1 * | 10/2008 | Nagata et al. | 323/280 |
| 2008/0278127 | A1 * | 11/2008 | Nagata | 323/276 |

FOREIGN PATENT DOCUMENTS

JP 2005-353037 12/2005

* cited by examiner

*Primary Examiner* — Bao Q Vu
(74) *Attorney, Agent, or Firm* — Dickstein Shapiro LLP

(57) ABSTRACT

A voltage regulator circuit and control method therefor. The circuit includes input and output terminals, an output transistor to pass a current from the input terminal to the output terminal according to a control signal, a reference voltage generator unit to generate and output a reference voltage, an output voltage detector unit to detect an output voltage output from the output terminal and generate and output a proportional voltage proportional to a detected voltage, a first error amplifier unit to control the output transistor to make the proportional voltage equal to the reference voltage, and a second error amplifier unit to respond to fluctuation in the output voltage faster than the first error amplifier unit and increase the output current from the output transistor for a period of time when the output voltage rapidly drops. Current consumption of the second error amplifier unit is changed according to the output current.

17 Claims, 5 Drawing Sheets

VOLTAGE REGULATOR CIRCUIT AND CONTROL METHOD THEREFOR

CROSS-REFERENCE TO RELATED APPLICATION

This patent specification is based on and claims priority from Japanese Patent Application No. 2007-057219 filed on Mar. 7, 2007 in the Japan Patent Office, the entire contents of which are hereby incorporated by reference herein.

BACKGROUND

1. Field of the Invention

The present invention relates to a voltage regulator circuit and a control method therefor.

2. Description of the Related Art

Recently, portable equipment that uses a battery, such as a mobile telephone, has come into widespread use. Such portable equipment generally employs a voltage regulator to maintain a constant voltage level. To improve load response characteristics of the voltage regulator, a voltage regulator circuit that amplifies an AC (alternating current) component of an output voltage for feedback to an output transistor is proposed.

FIG. 1 is a diagram illustrating example circuitry of such a voltage regulator circuit. The voltage regulator circuit 100 of FIG. 1 converts an input voltage $V_{in}$ applied to an input terminal IN into a constant voltage and outputs an output voltage $V_{out}$ from an output terminal OUT. The voltage regulator circuit 100 includes a first error amplifier 101 and a second error amplifier 110.

The first error amplifier 101 amplifies a voltage difference between a reference voltage $V_{ref}$ and a divided voltage VFB generated by dividing the output voltage $V_{out}$ by resistors R101 and R102, which is then output to the gate of an output transistor M101, thereby controlling a current output from the output transistor M101 to maintain the output voltage $V_{out}$ constant.

The second error amplifier 110 is an amplifier that responds faster than the first error amplifier 101 and has an input terminal connected to the output terminal OUT and an output terminal connected to the gate of the output transistor M101. The second error amplifier 110 amplifies an AC component of the output voltage $V_{out}$ and controls the gate voltage of the output transistor M101. That is, the second error amplifier 110 amplifies a change in the output voltage $V_{out}$ caused by fluctuation in load current and responds to control the gate voltage of the output transistor M101 faster than the first error amplifier 101 does, thereby greatly improving transient response characteristics.

However, bias current of the second error amplifier 110 is determined to be larger to achieve faster operation than that of the first error amplifier 101, resulting in increased current consumption. In particular, when the voltage regulator circuit 100 is used as a power source for a system having a heavy-load operating mode with normal current consumption and a light-load operating mode such as a sleep mode with low current consumption, the voltage regulator circuit 100 needs to have quick transient response characteristics for changes in load condition even in the light-load operating mode. When current consumption of the second error amplifier 110 is reduced to save power, response speed decreases and becomes insufficient for the change in the load condition. On the other hand, when current consumption of the second error amplifier 110 increases, current consumption in the light-load operating mode increases, shortening the life of a battery serving as a power source for the system.

SUMMARY

This patent specification describes a novel voltage regulator circuit that includes an input terminal, an output terminal, an output transistor to pass a current from the input terminal to the output terminal in accordance with a control signal, a reference voltage generator unit to generate and output a reference voltage, an output voltage detector unit to detect an output voltage output from the output terminal and generate and output a proportional voltage proportional to a detected output voltage, a first error amplifier unit to control the output transistor to make the proportional voltage equal to the reference voltage, and a second error amplifier unit to respond to fluctuation in the output voltage faster than the first error amplifier unit and increase the output current output from the output transistor for a period of time when the output voltage rapidly drops. Current consumption of the second error amplifier unit is changed in accordance with the output current output from the output transistor.

This patent specification further describes a novel control method for controlling the voltage regulator circuit, including outputting an output current from the output transistor and changing current consumption of the second error amplifier unit in accordance with the output current.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
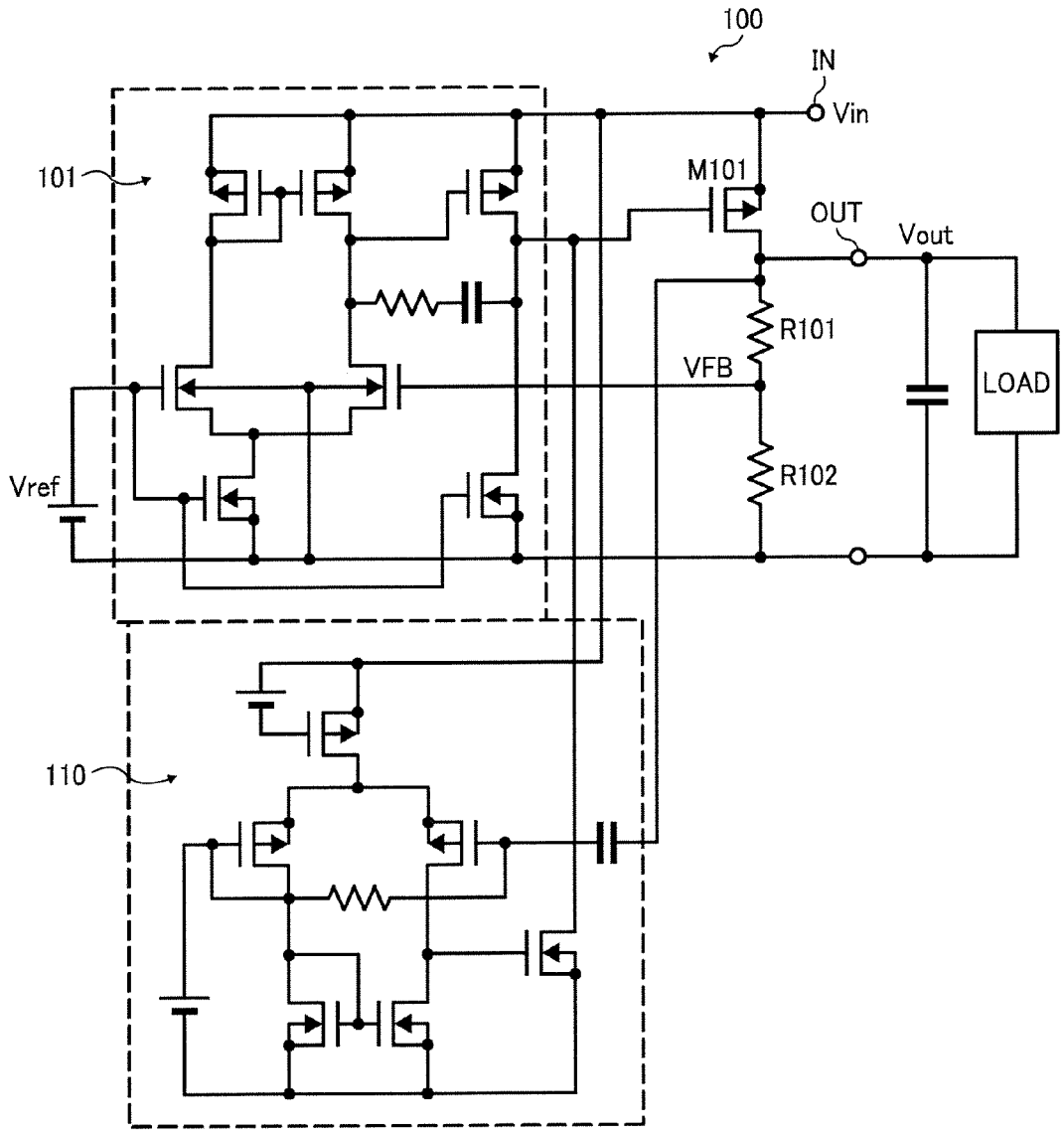
FIG.1 BACKGROUND ART
FIG. 1 is a diagram illustrating example circuitry of a background voltage regulator circuit.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
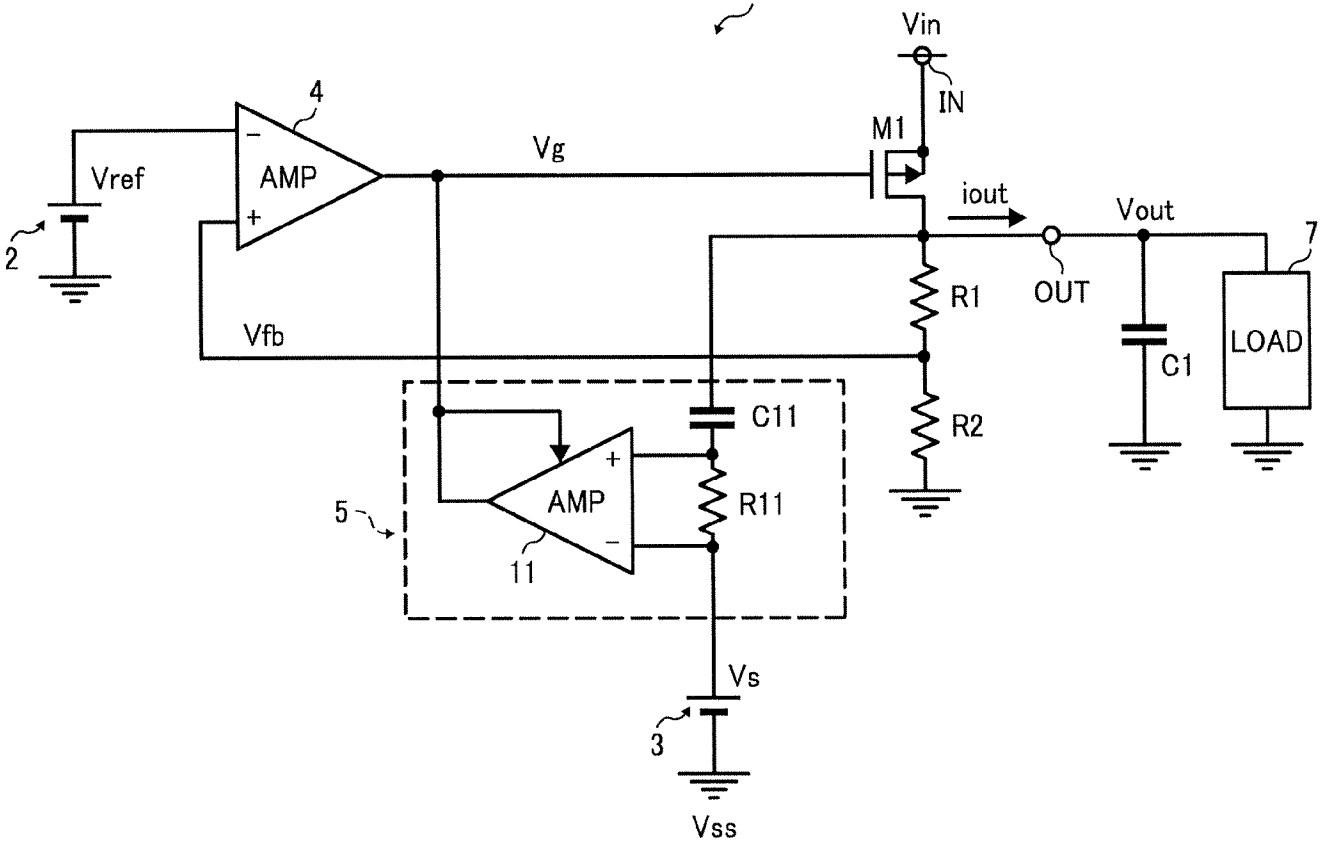
FIG. 2 is a diagram illustrating example circuitry of a voltage regulator circuit according to a first embodiment of the present invention.

Referring now to the drawings, wherein like reference numerals designate identical or corresponding parts throughout the several views thereof, and in the first instance to FIG. 2, voltage regulator circuits according to exemplary embodiments of the present invention are described.

FIG. 2 is a diagram illustrating example circuitry of a voltage regulator circuit according to a first embodiment.

A voltage regulator circuit 1 of FIG. 2 converts an input voltage $V_{in}$ applied to an input terminal IN into a constant voltage and outputs an output voltage $V_{out}$ from an output terminal OUT. A load 7 and a capacitor C1 are connected in parallel between the output terminal OUT and ground indicated by $V_{ss}$ in FIG. 2.

The voltage regulator circuit 1 includes a reference voltage generator 2 that generates and outputs a reference voltage $V_{ref}$, a bias voltage generator 3 that generates and outputs a bias voltage $V_s$, output voltage detection resistors R1 and R2 that divide the output voltage $V_{out}$ and generate and output a divided voltage $V_{fb}$, a PMOS (P-channel Metal Oxide Semiconductor) output transistor M1 that controls an output current $i_{out}$ outputted to the output terminal OUT according to a signal input to the gate thereof, a first error amplifier 4 that controls the output transistor M1 to make the divided voltage $V_{fb}$ equal to the reference voltage $V_{ref}$, and a second error amplifier 5. The first error amplifier 4 is formed of a circuit similar to, for example, the first error amplifier 101 of FIG. 1. The second error amplifier 5 includes a differential amplifier 11, a resistor R11, and a capacitor C11. The reference voltage generator 2 forms a reference voltage generator unit, the resistors R1 and R2 form an output voltage detector unit, the first error amplifier 4 forms a first error amplifier unit, and the bias voltage generator 3 and the second error amplifier 5 form a second error amplifier unit. The output transistor M1, the reference voltage generator 2, the bias voltage generator 3, the resistors R1 and R2, the first error amplifier 4, and the second error amplifier 5 are integrated on an IC (integrated circuit).

The output transistor M1 is connected between the input terminal IN and the output terminal OUT. The resistors R1 and R2 are connected in series between the output terminal OUT and ground, and output the divided voltage $V_{fb}$ from the connecting node therebetween. As for the first error amplifier 4, the reference voltage $V_{ref}$ is applied to the inverted input terminal, the divided voltage $V_{fb}$ is applied to the non-inverted input terminal, and the output terminal is connected to the gate of the output transistor M1. In the second error amplifier 5, the output terminal of the differential amplifier 11 is also connected to the gate of the output transistor M1, the bias voltage $V_s$ is applied to the inverted input terminal of the differential amplifier 11, and the output voltage $V_{out}$ is applied to the non-inverted input terminal of the differential amplifier 11 through the capacitor C11. The resistor R11 is connected between the non-inverted input terminal and the inverted input terminal of the differential amplifier 11. The output terminal of the differential amplifier 11 forms the output terminal of the second error amplifier 5. The first error amplifier 4 and the second error amplifier 5 output signals that control the output transistor M1.

Figure 3:
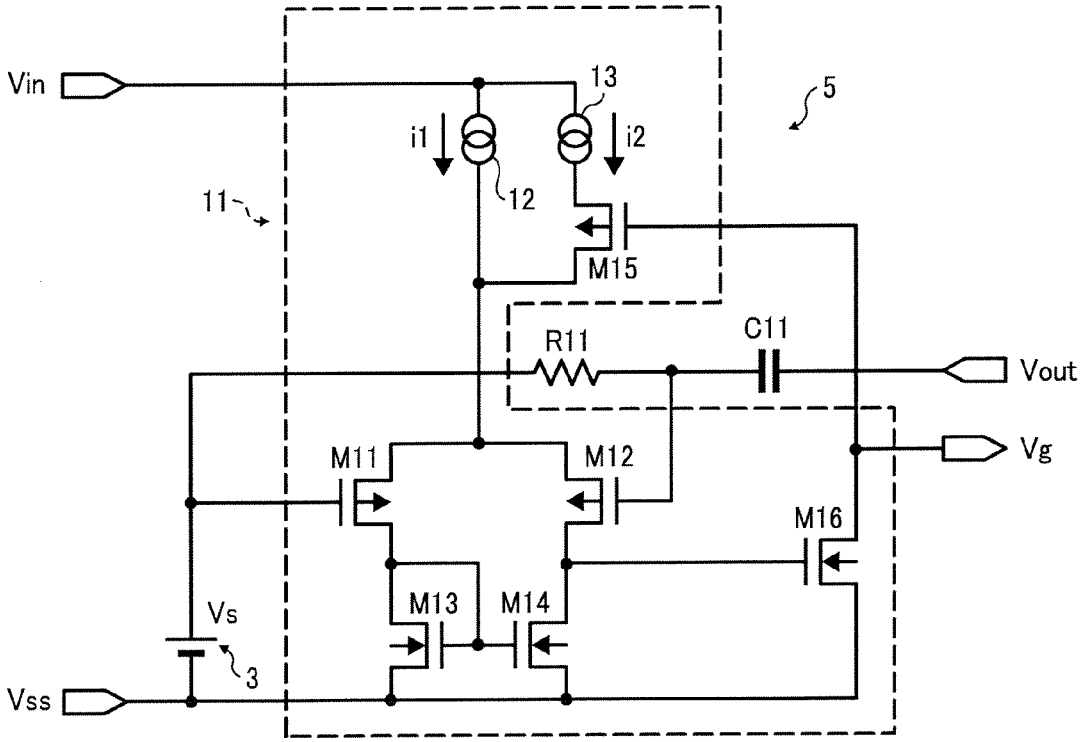
FIG. 3 is a diagram illustrating example internal circuitry of a second error amplifier of FIG. 2.

FIG. 3 is a diagram illustrating example internal circuitry of the second error amplifier 5 of FIG. 2.

As illustrated in FIG. 3, the differential amplifier 11 includes PMOS transistors M11, M12, and M15, NMOS (N-channel Metal Oxide Semiconductor) transistors M13, M14, and M16, and constant current sources 12 and 13. The PMOS transistors M11 and M12 form a differential pair component. The NMOS transistors M13 and M14 form a current mirror circuit and function as a load for the differential pair component. The sources of the NMOS transistors M13 and M14 are connected to ground, the gates thereof are connected to each other, and the connecting node thereof is connected to the drain of the NMOS transistor M13.

The drain of the NMOS transistor M13 is also connected to the drain of the PMOS transistor M11. The drain of the NMOS transistor M14 is connected to the drain of the PMOS transistor M12. The gate of the PMOS transistor M11 forms the inverted input terminal of the differential amplifier 11 and the gate of the PMOS transistor M12 forms the non-inverted input terminal of the differential amplifier 11. The sources of the PMOS transistors M11 and M12 are also connected to each other. Between the connecting node between the sources of the PMOS transistors M11 and M12 and the input terminal IN, the constant current source 13 and the PMOS transistor M15, which are connected in series, and the constant current source 12 are connected in parallel. The NMOS transistor M16 is connected between the gate of the PMOS transistor M15 and ground. The gate of the NMOS transistor M16 is connected to the connecting node between the PMOS transistor M12 and the NMOS transistor M14. The drain of the NMOS transistor M16 forms the output terminal of the differential amplifier 11.

The first error amplifier 4 is designed to have high DC (direct current) gain, which is higher than that of the second error amplifier 5. The second error amplifier 5 amplifies only an AC component of the output voltage $V_{out}$ by connecting the gate of the PMOS transistor M12 to the output terminal OUT through the capacitor C11 serving as a coupling capacitor. The current consumption of the differential amplifier 11 changes according to the output voltage of the differential amplifier 11, that is, according to the drain voltage of the NMOS transistor M16. In the output transistor M1, the drain current increases as the gate voltage $V_g$ decreases. Therefore, the current consumption of the differential amplifier 11 changes according to the drain current of the output transistor M1.

When the output current $i_{out}$ output from the output terminal OUT rapidly increases and the output voltage $V_{out}$ rapidly drops, the AC component of the output voltage $V_{out}$ is applied to the non-inverted input terminal of the differential amplifier 11 through the capacitor C11, thereby lowering the output voltage of the differential amplifier 11. Since the differential amplifier 11 responds faster than the first error amplifier 4, the differential amplifier 11 lowers the gate voltage $V_g$ and reduces the impedance of the output transistor M1, thereby increasing the output voltage $V_{out}$ before the output voltage of the first error amplifier 4 drops. As a result, fluctuation in the output voltage $V_{out}$ is reduced.

Further, at least one of the PMOS transistors M11 and M12 may employ an offset mechanism so that the PMOS transistor M11 outputs large current in comparison to current the PMOS transistor M12 outputs under a condition in which an equal voltage is applied to each gate thereof. This is achieved by, for example, forming the PMOS transistor M11 with a size W/L (gate width/gate length) of 40 μm/2 μm and the PMOS transistor M12 with a size W/L of 32 μm/2 μm. In other words, the PMOS transistor M11 and the PMOS transistor M12 are formed with a size ratio of approximately 10:8.

Consequently, the output transistor M1 is not controlled by the NMOS transistor M16 except when the output voltage $V_{out}$ rapidly drops. Therefore, the second error amplifier 5 does not affect the control operation for the output transistor M1 by the first error amplifier 4 under normal operating conditions in which a change in the output voltage $V_{out}$ is at or below a given value.

The gate voltage $V_g$ of the output transistor M1 is applied to the gate of the PMOS transistor M15, and the drain current of the PMOS transistor M15 changes according to the gate voltage $V_g$, that is, according to the output current $i_{out}$ output from the output terminal OUT. The bias current of the differential amplifier 11 includes a constant current i1 supplied by the constant current source 12 and the drain current of the PMOS transistor M15, and therefore increases or decreases in proportion to the output current $i_{out}$.

When the drain current of the PMOS transistor M15 decreases to zero, the bias current of the differential amplifier 11 is equal to the constant current i1, and does not decrease below the constant current i1. The drain current of the PMOS transistor M15 is limited by the constant current source 13 and does not exceed a constant current i2 supplied by the constant current source 13 no matter how low the gate voltage $V_g$ drops. Therefore, the bias current of the differential amplifier 11 changes in proportion to the output current $i_{out}$ with a current value from i1 to i1+i2.

Figure 4:
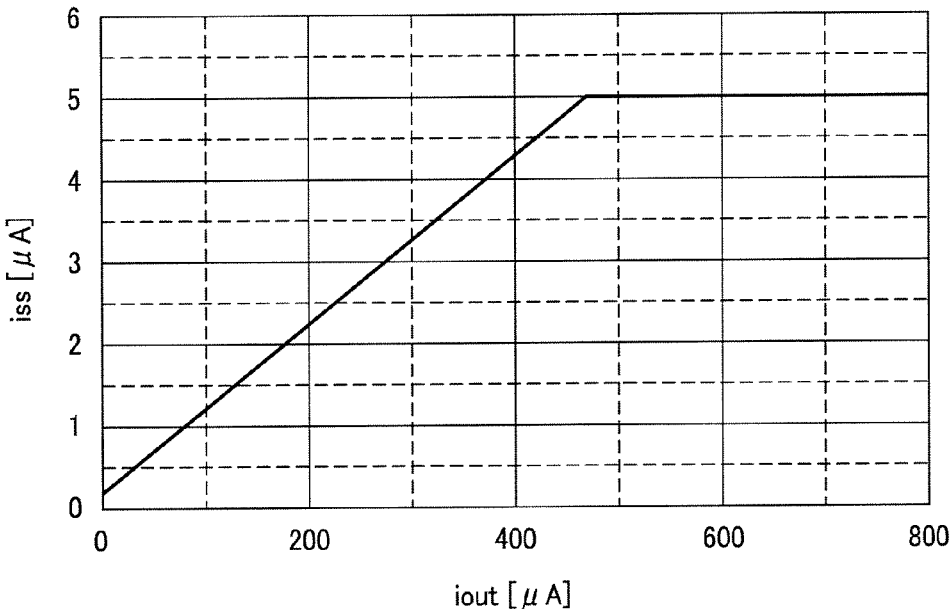
FIG. 4 is a graph illustrating an example relation between an output current of the voltage regulator circuit and current consumption of a differential amplifier of FIG. 2.

FIG. 4 is a graph illustrating an example relation between the output current $i_{out}$ and the current consumption of the differential amplifier 11, which is indicated by $i_{ss}$. In the example illustrated in FIG. 4, the constant current i1 is approximately 0.2 μA and the constant current i1+i2 is approximately 5 μA.

As can be seen in FIG. 4, the current consumption $i_{ss}$ of the differential amplifier 11 is proportional to the output current $i_{out}$ with a current value from approximately 0.2 μA to approximately 5 μA, beyond which current consumption $i_{ss}$ does not increase further.

Figure 5:
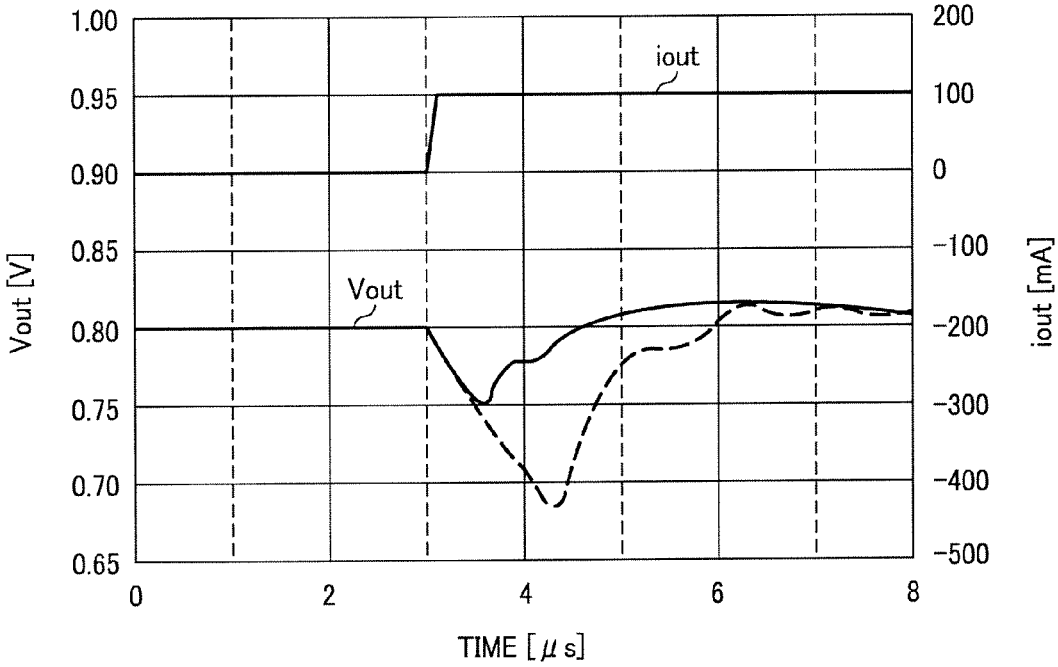
FIG. 5 is a graph illustrating an example change in an output voltage of the voltage regulator circuit when the output current rapidly increases.

FIG. 5 is a graph illustrating an example change in the output voltage $V_{out}$ when the output current $i_{out}$ rapidly increases in the voltage regulator circuit 1 illustrated in FIGS. 2 and 3. In the example illustrated in FIG. 5, the output current $i_{out}$ rapidly increases from 500 μA to 100 mA in the voltage regulator circuit 1 when the input voltage $V_{in}$ is 1.8 V, the output voltage $V_{out}$ is 0.8 V, and the capacitance between the output terminal OUT and ground is 1 μF. In FIG. 5, the continuous line represents the output voltage $V_{out}$ of the voltage regulator circuit 1 and the dashed line represents the output voltage $V_{out}$ of a typical voltage regulator circuit.

As can be seen in FIG. 5, fluctuation in the output voltage $V_{out}$ is greatly reduced compared to that in the typical output voltage $V_{out}$ when the output current $i_{out}$ rapidly increases.

The voltage regulator circuit according to the first embodiment is designed to maintain the output voltage $V_{out}$ constant by controlling the output transistor M1 using the first error amplifier 4 with high DC gain during a normal operation and, when the output voltage $V_{out}$ rapidly drops, using the fast response second error amplifier 5 for a period of time before the first error amplifier 4 responds to the voltage drop to control the output transistor M1. Further, the bias current of the differential amplifier 11 in the second error amplifier 5 changes in proportion to the output current $i_{out}$. Therefore, the voltage regulator circuit can have fast load transient response characteristics and reduce current consumption in a light-load state in which the output current $i_{out}$ is small.

The bias current of the differential amplifier 11 increases in proportion to the output current $i_{out}$ in the first embodiment described above. Alternatively, the bias current of the differential amplifier 11 in the second error amplifier 5 may increase by the constant current i2 when the output current $i_{out}$ is at or above a given value, which is described below as a second embodiment.

Although the reference numerals for the differential amplifier and the second error amplifier in the second embodiment are changed to 11*a* and 5*a*, respectively, example circuitry of the voltage regulator circuit according to the second embodiment is the same as that of the voltage regulator circuit 1 illustrated in FIG. 2, and therefore the illustration thereof is omitted.

Figure 6:
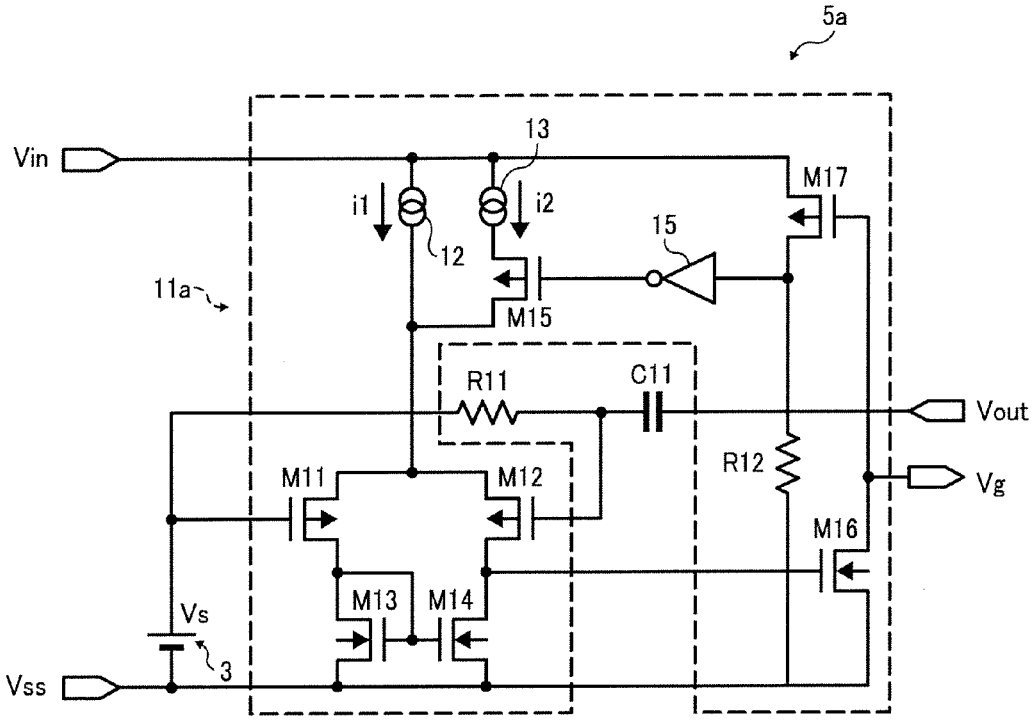
FIG. 6 is a diagram illustrating example circuitry of a second error amplifier included in a voltage regulator circuit according to a second embodiment of the present invention.

FIG. 6 is a diagram illustrating example circuitry of a second error amplifier 5*a* included in the voltage regulator circuit according to the second embodiment. In FIG. 6, the same reference numerals as those of FIG. 3 designate the same or similar components, and a description thereof is omitted. The following description concentrates on a difference between the second error amplifier 5 of FIG. 3 and the second error amplifier 5*a* of FIG. 6.

Specifically, the second error amplifier 5*a* is the same as the second error amplifier 5, except that a PMOS transistor M17, an inverter 15, and a resistor R12 are added.

In FIG. 6, the second error amplifier 5*a* includes a differential amplifier 11*a*, a resistor R11, and a capacitor C11. The differential amplifier 11*a* includes PMOS transistors M11, M12, M15, and M17, NMOS transistors M13, M14, and M16, constant current sources 12 and 13, the inverter 15, and the resistor R12.

The PMOS transistor M17 and the resistor R12 are connected in series between the input terminal IN and ground. The input terminal of the inverter 15 is connected to the connecting node between the PMOS transistor M17 and the resistor R12 and the output terminal of the inverter 15 is connected to the gate of the PMOS transistor M15. The gate of the PMOS transistor M17 is connected to the drain of the NMOS transistor M16 and the gate voltage $V_g$ of the output transistor M1 is applied thereto.

By applying the gate voltage $V_g$ to the gate of the PMOS transistor M17, the drain current of the PMOS transistor M17 changes according to the output current $i_{out}$. The resistor R12 converts the drain current of the PMOS transistor M17 into a voltage. When this voltage is at or below a threshold value of the inverter 15, the output of the inverter 15 is high, turning off the PMOS transistor M15 and cutting the circuit. Therefore, the bias current of the differential amplifier 11*a* is the constant current i1. When the input voltage of the inverter 15 exceeds the threshold value of the inverter 15, the output of the inverter 15 falls to a low level, turning on the PMOS transistor M15 for conduction. As a result, the bias current of the differential amplifier 11*a* increases from the constant current i1 to the constant current i1+i2.

Figure 7:
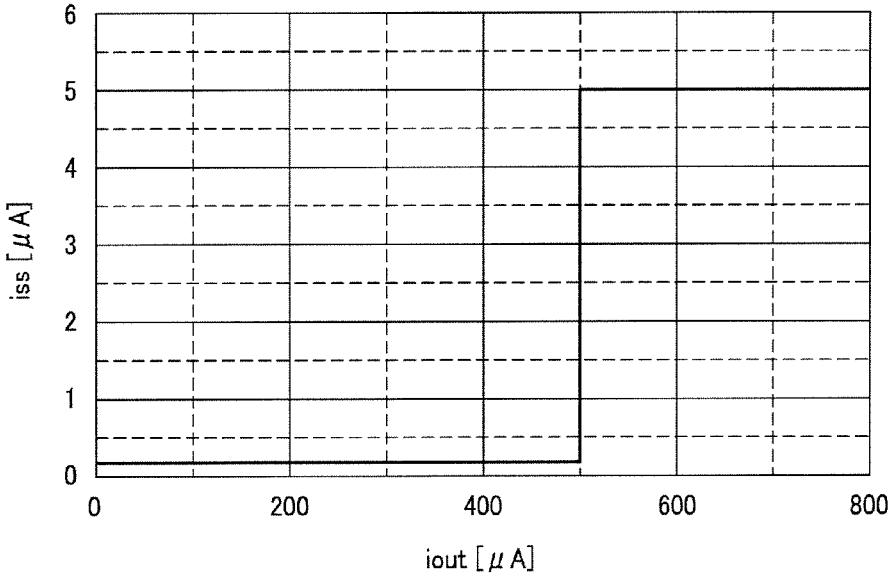
FIG. 7 is a graph illustrating an example relation between an output current of the voltage regulator circuit and current consumption of a differential amplifier of FIG. 6.

FIG. 7 is a graph illustrating an example relation between the output current $i_{out}$ and the current consumption $i_{ss}$ of the differential amplifier 11*a*. In the example illustrated in FIG. 7, the constant current i1 is approximately 0.2 μA and the constant current i1+i2 is approximately 5 μA.

As can be seen in FIG. 7, the current consumption $i_{ss}$ of the differential amplifier 11*a* increases from approximately 0.2 μA to approximately 5 μA when the output current $i_{out}$ is at or above a given value. This given value can be freely set based on a size of the PMOS transistor M17 and a resistance value of the resistor R12 so that the constant current i1+i2 is small relative to the output current $i_{out}$. For example, when the constant current i1 is 0.2 μA and the constant current i1+i2 is 5 μA, the given value can be set to 500 μA without any problem, since the increase in the bias current from the constant current i1 to the constant current i1+i2 is within the margin of error in terms of total current consumption.

The illustration of an example change in the output voltage $V_{out}$ when the output current $i_{out}$ rapidly increases in the second embodiment is the same as FIG. 5, and is therefore omitted.

The voltage regulator circuit according to the second embodiment increases the bias current of the differential amplifier 11*a* in the error amplifier 5*a* by the constant current i2 when the output current $i_{out}$ is at or above a given value, thereby achieving the same effect as that of the first embodiment in which the bias current of the differential amplifier 11 increases in proportion to the output current $i_{out}$.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A voltage regulator circuit comprising:

an input terminal;

an output terminal;

an output transistor configured to pass a current from the input terminal to the output terminal in accordance with a control signal;

a reference voltage generator unit configured to generate and output a reference voltage;

an output voltage detector unit configured to detect an output voltage output from the output terminal and generate and output a proportional voltage proportional to a detected output voltage;

a first error amplifier unit configured to control the output transistor to make the proportional voltage equal to the reference voltage; and a second error amplifier unit configured to respond to fluctuation in the output voltage faster than the first error amplifier unit and increase the output current output from the output transistor for a period of time when the output voltage rapidly drops, wherein the second error amplifier comprises a first constant current source supplying a first constant current and a second constant current source supplying a second constant current, and a bias current of the second error amplifier unit is changed in accordance with the current output from the output transistor.

2. The voltage regulator circuit according to claim 1, wherein the first error amplifier unit has a direct current gain higher than a direct current gain of the second error amplifier unit.

3. The voltage regulator circuit according to claim 1, wherein the second error amplifier unit amplifies only an alternating current component of the output voltage.

4. The voltage regulator circuit according to claim 1, wherein the output transistor, the reference voltage generator unit, the output voltage detector unit, and the first and second error amplifier units are integrated on an integrated circuit.

5. The voltage regulator circuit according to claim 1, wherein the second error amplifier unit changes current consumption of the second error amplifier unit in proportion to the output current output from the output transistor.

6. The voltage regulator circuit according to claim 5, wherein the second error amplifier unit further comprises:

a differential amplifier configured to control the output transistor to make a voltage applied to a first input terminal equal to a bias voltage applied to a second input terminal;

a capacitor connected between the first input terminal of the differential amplifier and the output terminal; and a fixed resistor connected between the first and second input terminals of the differential amplifier, wherein the differential amplifier changes the bias current, which is supplied to a differential pair component thereof, in accordance with a voltage at a control electrode of the output transistor, to a sum of the first constant current and a portion of the second constant current proportional to a value of the output current output from the output transistor.

7. The voltage regulator circuit according to claim 1, wherein the second error amplifier unit increases current consumption of the second error amplifier unit when the output current output from the output transistor is at or above a given value.

8. The voltage regulator circuit according to claim 7, wherein the second error amplifier unit further comprises:

a differential amplifier configured to control the output transistor to make a voltage applied to a first input terminal equal to a bias voltage applied to a second input terminal;

a capacitor connected between the first input terminal of the differential amplifier and the output terminal; and a fixed resistor connected between the first and second input terminals of the differential amplifier, wherein the differential amplifier increases the bias current, which is supplied to a differential pair component thereof, when the output current output from the output transistor of at or above the given value is detected from a voltage at a control electrode of the output transistor.

9. The voltage regulator circuit according to claim 1, wherein the second error amplifier unit further comprises:

a differential amplifier configured to control the output transistor to make a voltage applied to a first input terminal equal to a bias voltage applied to a second input terminal;

a capacitor connected between the first input terminal of the differential amplifier and the output terminal; and a fixed resistor connected between the first and second input terminals of the differential amplifier, wherein the differential amplifier changes the bias current, which is supplied to a differential pair component thereof, in accordance with a voltage at a control electrode of the output transistor.

10. The voltage regulator circuit according to claim 9, wherein the differential pair component comprises first and second transistors, at least one of which includes an offset mechanism to minimize a current flowing through one of the first and second transistors in comparison to a current flowing through the other of the first and second transistors when a change in the output voltage is at or below a given value.

11. A control method for controlling a voltage regulator circuit comprising:

outputting an output current from an output transistor; an changing a bias current of an error amplifier unit which controls said output transistor between an output of a first constant current source and a sum of the output of the first constant current source and an output of a second constant current source in accordance with the output current.

12. The control method according to claim 11, wherein the bias current is supplied to a differential pair component included in the error amplifier unit.

13. The control method according to claim 11, wherein the changing a bias current comprises changing current consumption of the error amplifier unit in proportion to the output current.

14. The control method according to claim 13, wherein the bias current is supplied to a differential pair component included in the error amplifier unit in proportion to the output current.

15. The control method according to claim 11, wherein the changing a bias current comprises increasing current consumption of the error amplifier unit when the output current is at or above a given value.

16. The control method according to claim 15, further comprising:

increasing the bias current, which is supplied to a differential pair component included in the error amplifier unit, when the output current is at or above the given value.

17. The voltage regulator circuit according to claim 1, wherein the bias current is changed between an output of a first constant current source and a sum of the output of the first constant current source and an output of a second constant current source in accordance with the current output from the output transistor.

* * * * *